US005902215A

United States Patent [19]

Kuo

[11] Patent Number: 5,902,215

[45] Date of Patent: May 11, 1999

[54] EXERCISE BICYCLE

[76] Inventor: Min Kuo, 11, Lane 70, Shen Lin Rd., Shen Gang, Taichung Hsien, Taiwan

[21] Appl. No.: 09/027,542

[22] Filed: Feb. 23, 1998

[51] Int. Cl.[6] ..... A63B 21/00

[52] U.S. Cl. ..... 482/57; 74/560

[58] Field of Search ..... 74/560–566; 482/54, 482/57

[56] References Cited

U.S. PATENT DOCUMENTS 5,755,635 5/1998 Scaramozzino ..... 474/150

*Primary Examiner*—Glenn Richman

*Attorney, Agent, or Firm*—Alay Kamrath

[57] ABSTRACT

An exercise bicycle has a main body, a sprocket wheel disposed in the main body, a chain surrounding the main body, a main shaft passing through the sprocket wheel, a fixed crank connected to the main shaft, an adjustable crank connected to the main shaft, a first pedal disposed on the adjustable crank, a second pedal disposed on the fixed crank, a seat post disposed on the main body, a seat disposed on the seat post, a head tube disposed on the main body, a front support rod supporting a front bottom of the main body, and a rear support rod supporting a rear bottom of the main body.

2 Claims, 7 Drawing Sheets

EXERCISE BICYCLE

BACKGROUND OF THE INVENTION

The present invention relates to an exercise bicycle. More particularly, the present invention relates to an exercise bicycle which has an adjustable crank.

A conventional exercise bicycle has two cranks which cannot be adjusted. Therefore, the pedals which are disposed on the cranks can be treaded to exercise the feet only. The conventional exercise bicycle has a main body, a sprocket wheel disposed in the main body, a main shaft passing through the sprocket wheel, two cranks connected to the main shaft, two pedals disposed on the cranks, a seat post disposed on the main body, a seat disposed on the seat post, a head tube disposed on the main body, a front support rod supporting a front bottom of the main body, and a rear support rod supporting a rear bottom of the main body.

SUMMARY OF THE INVENTION

An object of the present invention is to provide an exercise bicycle which has an adjustable crank to be adjusted easily.

Accordingly, an exercise bicycle comprises a main body, a sprocket wheel disposed in the main body, a chain surrounding the main body, a main shaft passing through the sprocket wheel, a fixed crank connected to the main shaft, an adjustable crank connected to the main shaft, a first pedal disposed on the adjustable crank, a second pedal disposed on the fixed crank, a seat post disposed on the main body, a seat disposed on the seat post, a head tube disposed on the main body, a front support rod supporting a front bottom of the main body, and a rear support rod supporting a rear bottom of the main body.

DETAILED DESCRIPTION OF THE INVENTION

Figure 1:
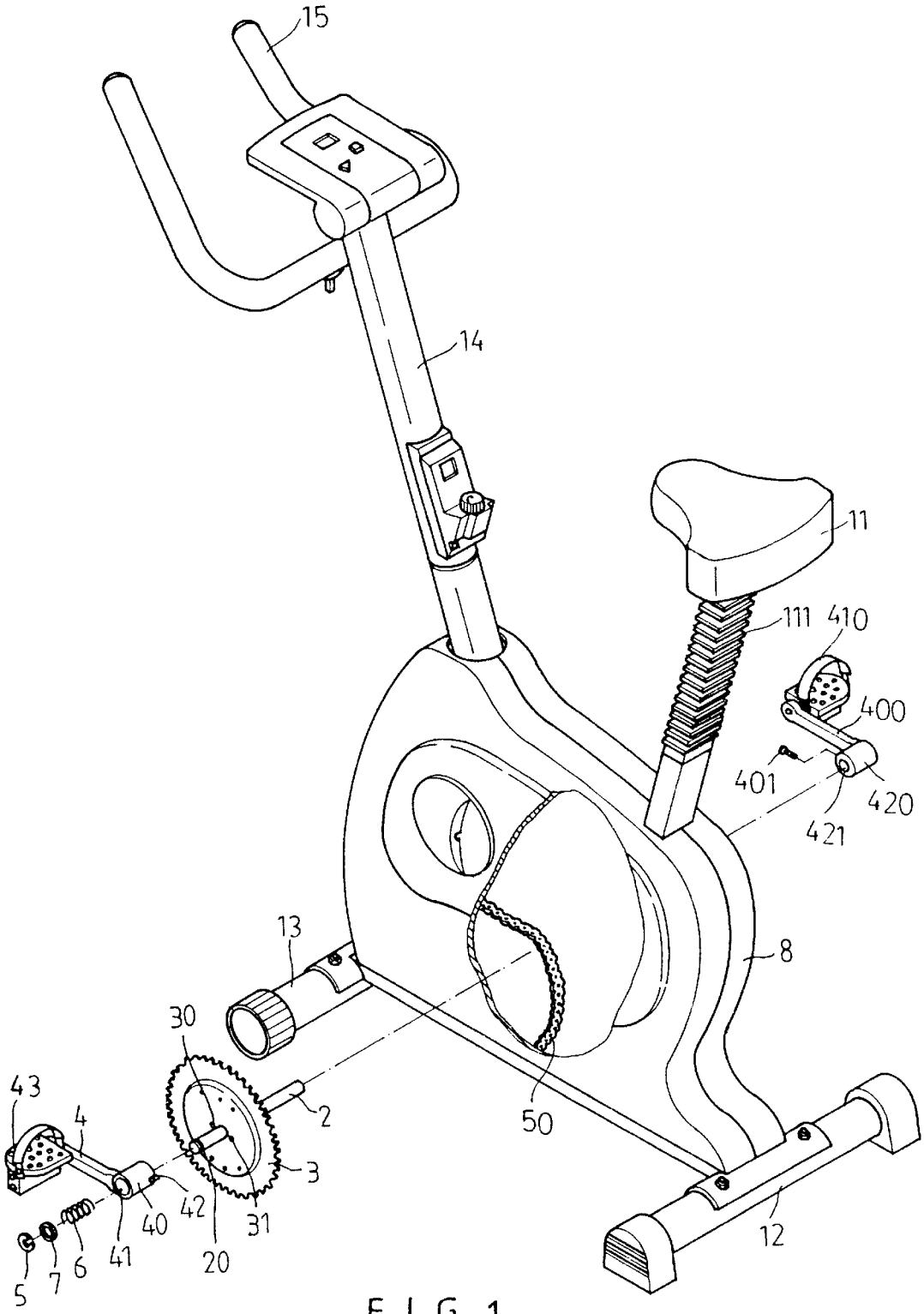
FIG. 1 is a perspective exploded view of an exercise bicycle of a preferred embodiment in accordance with the present invention.
Figure 2:
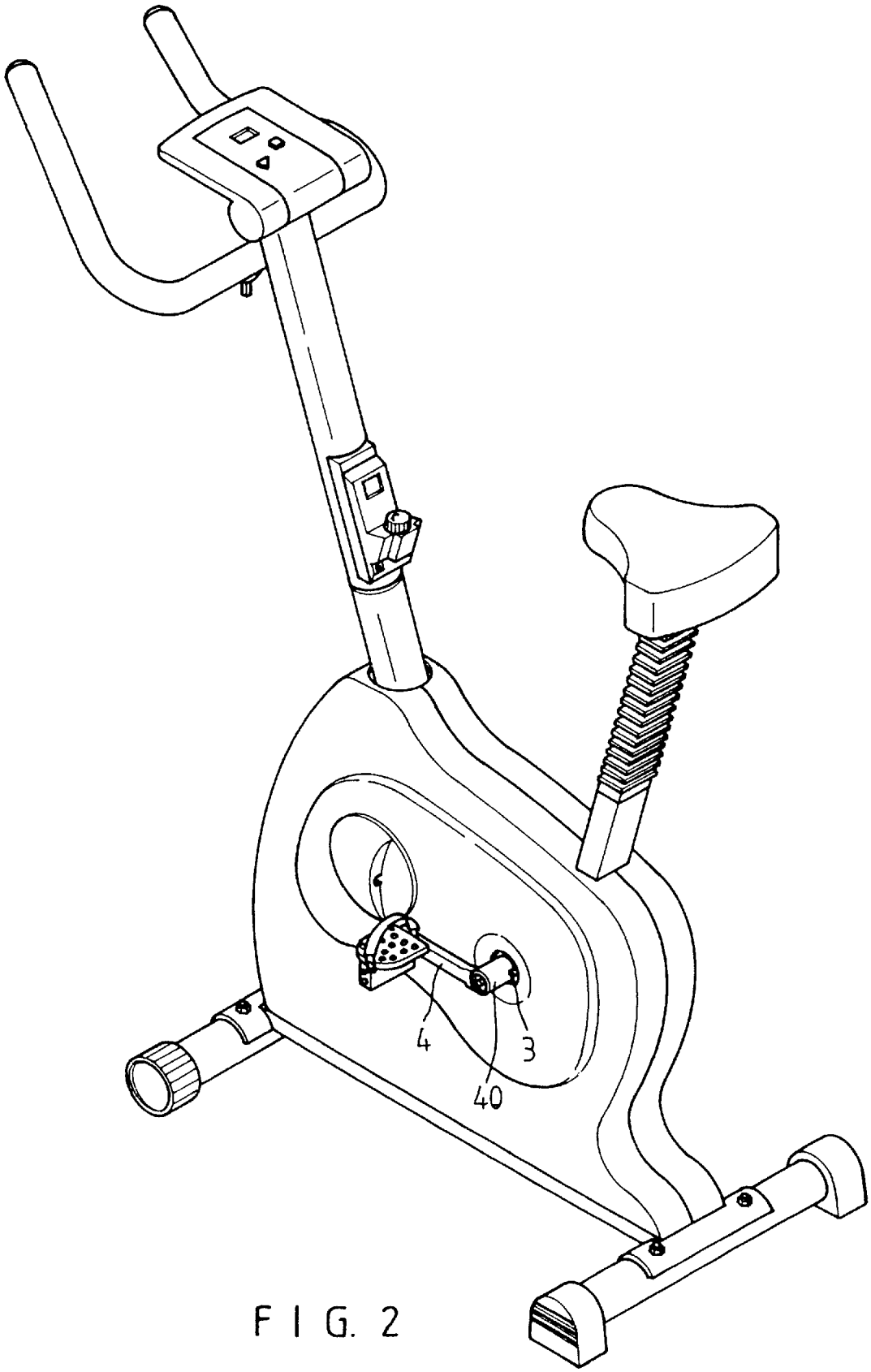
FIG. 2 is a perspective assembly view of an exercise bicycle of a preferred embodiment in accordance with the present invention.
Figure 3:
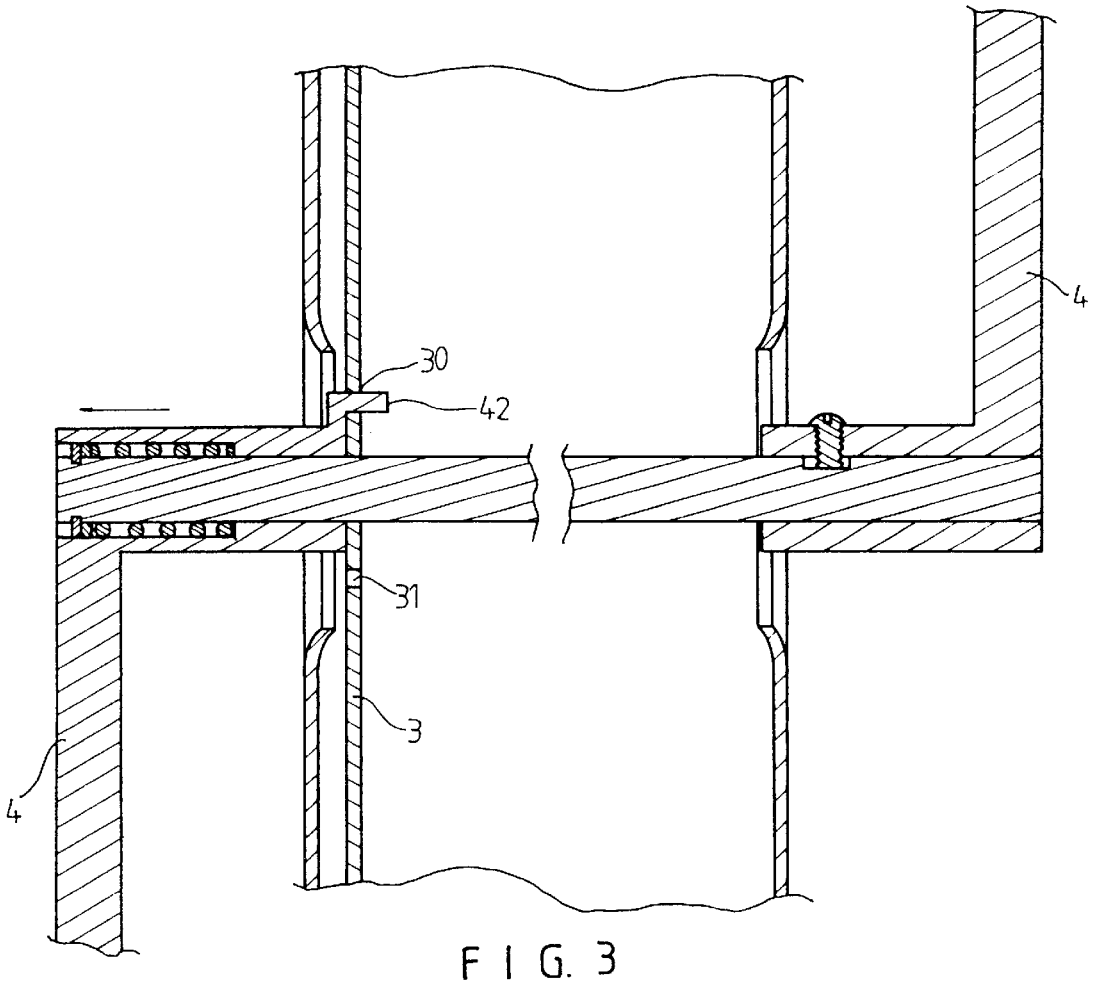
FIG. 3 is a first sectional schematic view illustrating an adjustment of an adjustable crank of a preferred embodiment in accordance with the present invention.

Referring to FIGS. 1 to 3, an exercise bicycle comprises a main body 8, a sprocket wheel 3 disposed in the main body 8, a chain 50 surrounding the main body 8, a main shaft 2 passing through the sprocket wheel 3, a fixed crank 400 connected to the main shaft 2, an adjustable crank 4 connected to the main shaft 2, a first pedal 43 disposed on the adjustable crank 4, a second pedal 410 disposed on the fixed crank 400, a seat post 111 disposed on the main body 8, a seat 11 disposed on the seat post 111, a head tube 14 disposed on the main body 8, a front support rod 13 supporting a front bottom of the main body 8, and a rear support rod 12 supporting a rear bottom of the main body 8.

The sprocket wheel 3 has a first aperture 30 and a second aperture 31.

An annular groove 20 is formed on the main shaft 2.

The adjustable crank 4 has a hollow sleeve 40, a center hole 41 formed in the hollow sleeve 40 to receive the main shaft 2, and a protrusion 42 disposed on the hollow sleeve 40. A coiled spring 6 is inserted in the hollow sleeve 40. The main shaft 2 passes through the center hole 41, the coiled spring 6, and a washer 7. A C-shaped retainer 5 is inserted in the annular groove 20. The protrusion 42 is inserted in the first aperture 30.

The fixed crank 400 has a hollow sleeve 420, a center hole 421 formed in the hollow sleeve 420 to receive the main shaft 2, and a fastener 401 fastening the hollow sleeve 420 and the main shaft 2 together.

Figure 5:
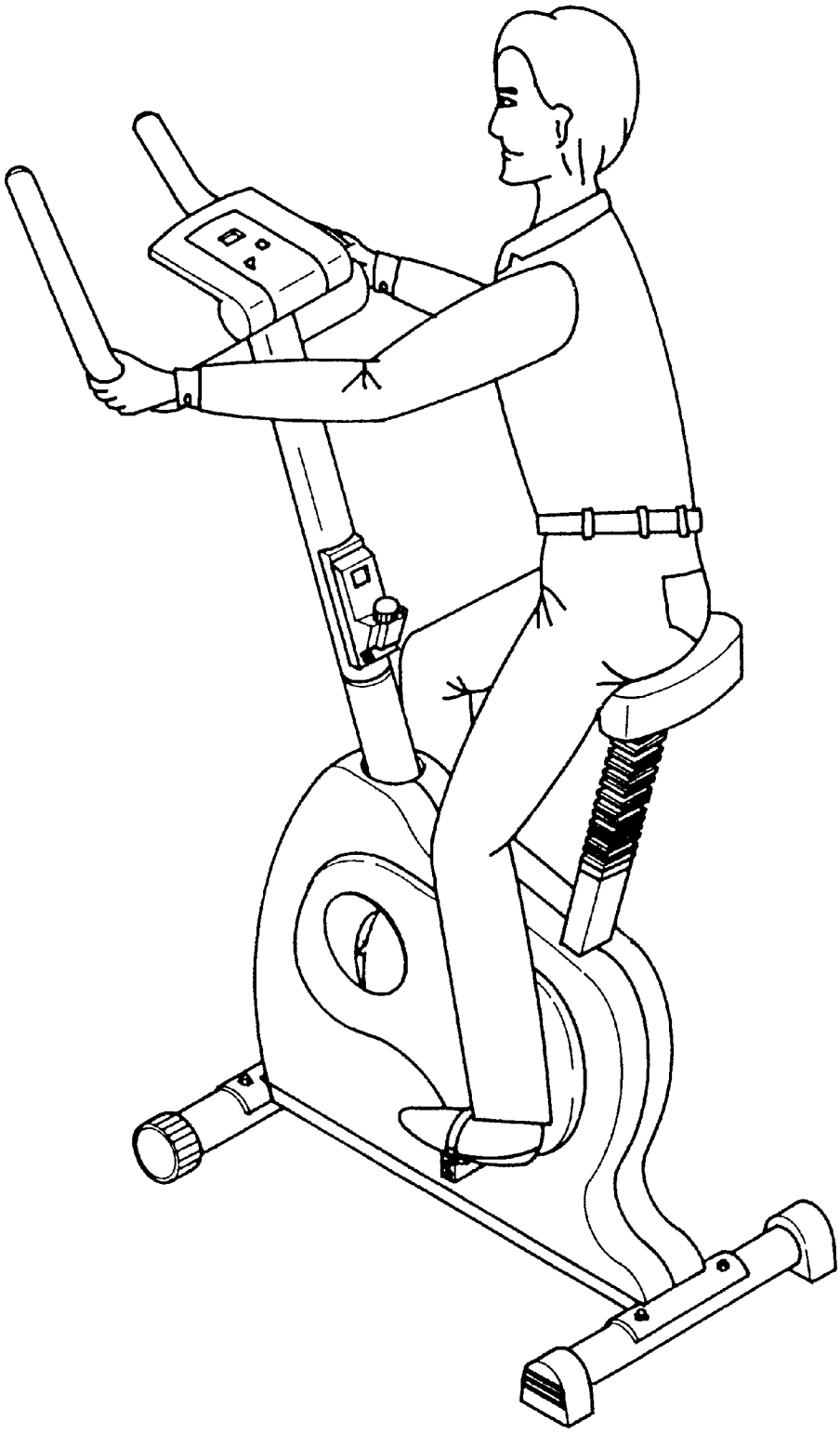
FIG. 5 is another schematic view illustrating an application of an exercise bicycle of a preferred embodiment in accordance with the present invention.

Referring to FIG. 5, the user can tread the first pedal 43 and the second pedal 410 as treading a bicycle.

Figure 3A:
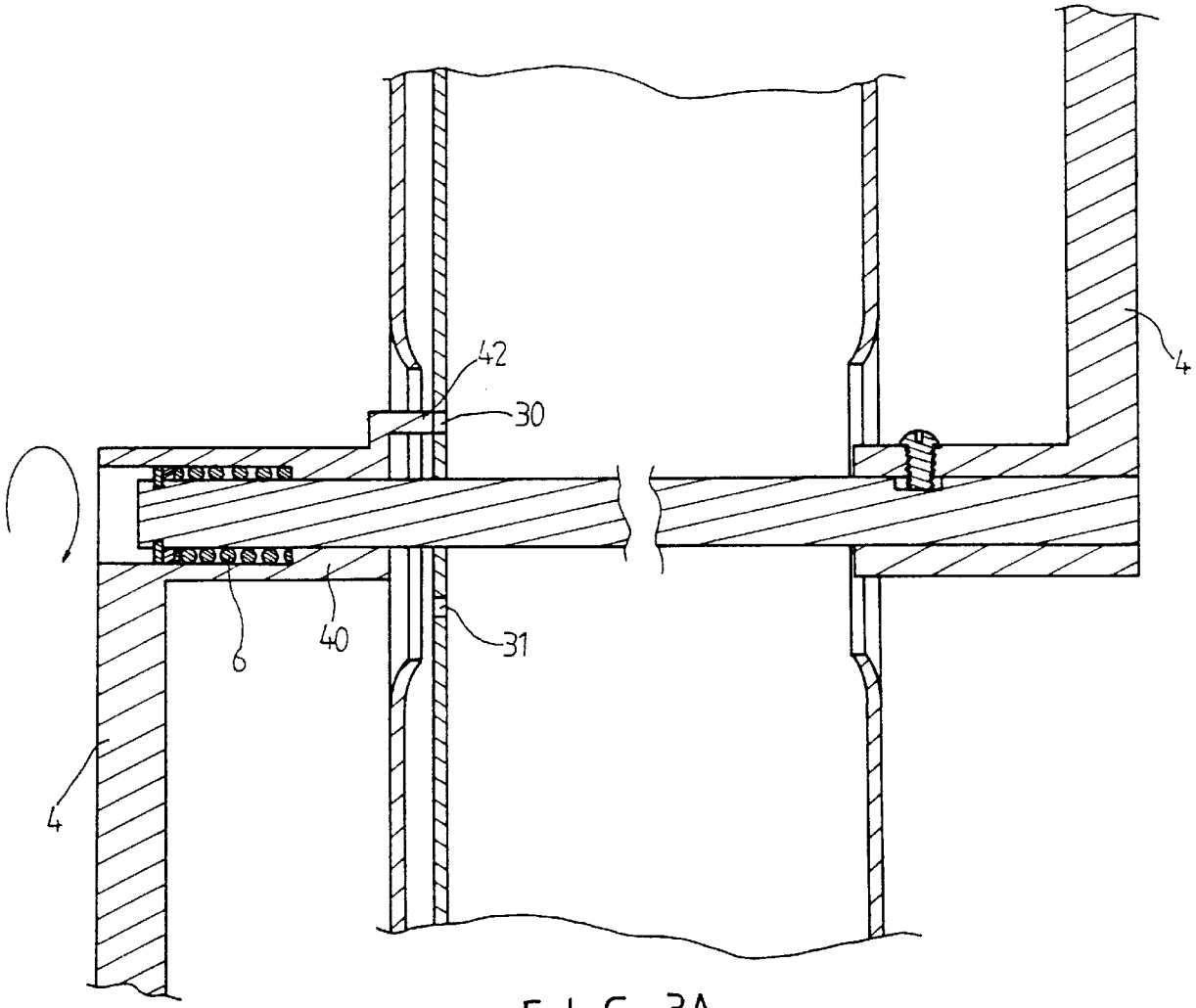
FIG. 3A is a second sectional schematic view illustrating an adjustment of an adjustable crank of a preferred embodiment in accordance with the present invention.
Figure 3B:
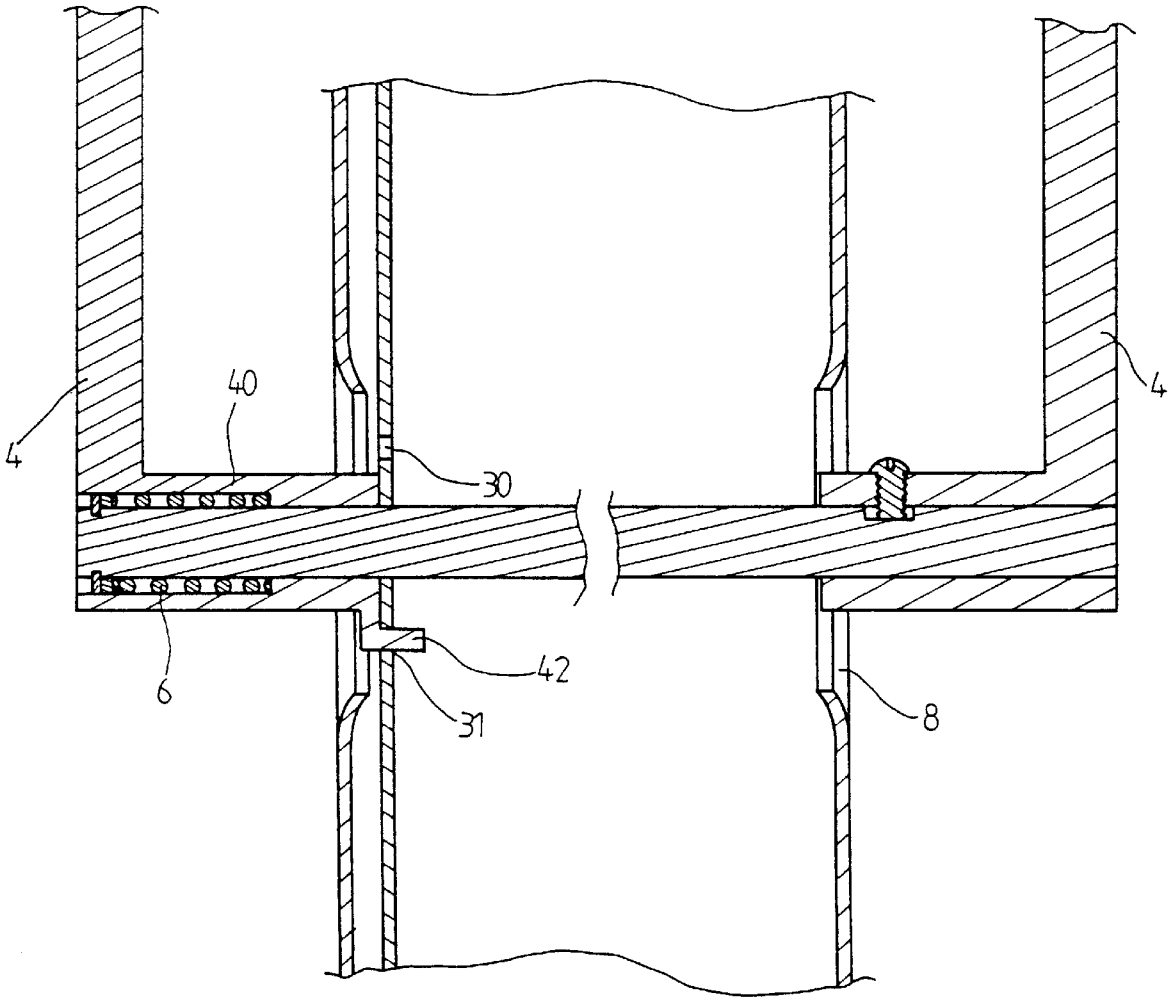
FIG. 3B is a third sectional schematic view illustrating an adjustment of an adjustable crank of a preferred embodiment in accordance with the present invention.

Referring to FIGS. 3A and 3B, the adjustable crank 4 is pulled outward. The protrusion 42 disengages from the first aperture 30. The protrusion 42 is inserted in the second aperture 31.

Figure 4:
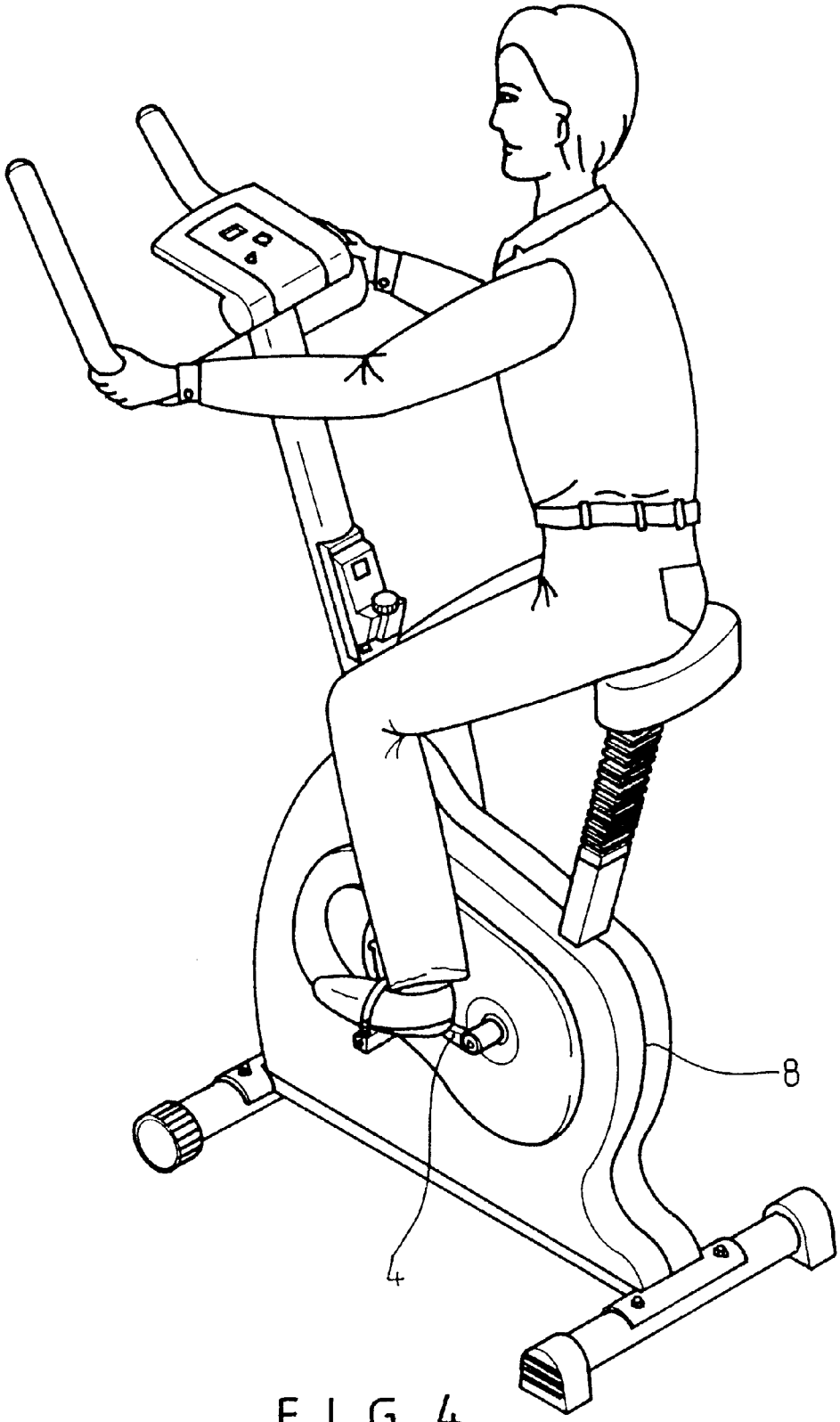
FIG. 4 is a schematic view illustrating an application of an exercise bicycle of a preferred embodiment in accordance with the present invention.

Referring to FIG. 4, the fixed crank 400 and the adjustable crank 4 are disposed in the opposite position.

The invention is not limited to the above embodiment but various modification thereof may be made. Further, various changes in form and detail may be made without departing from the scope of the invention.

I claim:

1. An exercise bicycle comprising, in combination:

a main body, a sprocket wheel disposed in the main body, a chain surrounding the main body, a main shaft passing through the sprocket wheel, a fixed crank connected to the main shaft, an adjustable crank connected to the main shaft, a first pedal disposed on the adjustable crank, a second pedal disposed on the fixed crank, a seat post disposed on the main body, a seat disposed on the seat post, a head tube disposed on the main body, a front support rod supporting a front bottom of the main body, a rear support rod supporting a rear bottom of the main body, with the sprocket wheel having a first aperture and a second aperture, an annular groove formed on the main shaft, with the adjustable crank having a first hollow sleeve, a first center hole formed in the first hollow sleeve to receive the main shaft and a protrusion disposed on the first hollow sleeve, a coiled spring inserted in the first hollow sleeve, with the main shaft passing through the first center hole, the coiled spring and a washer, and a C-shaped retainer inserted in the annular groove, with the protrusion inserted in the first aperture.

2. An exercise bicycle as claimed in claim 1, wherein the fixed crank has a hollow sleeve, a center hole formed in the hollow sleeve to receive the main shaft, and a fastener fastening the hollow sleeve and the main shaft together.

* * * * *